US011369209B2

(12) United States Patent
Chan et al.

(10) Patent No.: US 11,369,209 B2
(45) Date of Patent: Jun. 28, 2022

(54) BASSINET

(71) Applicant: JUNO BABY LLC, Seattle, WA (US)

(72) Inventors: Herman Chan, Seattle, WA (US); Thomas Duester, Seattle, WA (US)

(73) Assignee: JUNO BABY LLC, Seattle, WA (US)

( * ) Notice: Subject to any disclaimer, the term of this patent is extended or adjusted under 35 U.S.C. 154(b) by 60 days.

(21) Appl. No.: 16/913,689

(22) Filed: Jun. 26, 2020

(65) Prior Publication Data

US 2020/0405074 A1 Dec. 31, 2020

Related U.S. Application Data

(60) Provisional application No. 62/868,404, filed on Jun. 28, 2019.

(51) Int. Cl.
*A47D 9/00* (2006.01)

(52) U.S. Cl.
CPC ..... *A47D 9/005* (2013.01)

(58) Field of Classification Search
CPC ..... A47D 7/00; A47D 7/002; A47D 7/005; A47D 7/01; A47D 9/00; A47D 9/005
See application file for complete search history.

(56) References Cited

U.S. PATENT DOCUMENTS 2,553,579 A † 5/1951 Harris
3,336,608 A † 8/1967 Lerner
3,487,479 A * 1/1970 Grooms ..... A47D 13/02 5/99.1
4,934,004 A * 6/1990 Friedman ..... B60N 2/2854 5/118
5,099,988 A * 3/1992 Garran ..... B65D 81/368 206/223
6,526,608 B1 † 3/2003 Hsia
6,817,046 B1 † 10/2004 Srour
2005/0071919 A1 * 4/2005 Kenan ..... A47C 4/021 5/93.1
2018/0027990 A1 * 2/2018 Kroeker ..... A47D 9/005
2021/0100370 A1 * 4/2021 Brink ..... A47D 15/008

FOREIGN PATENT DOCUMENTS

WO 2004056241 A2 † 7/2004
WO WO2004056241 A2 † 7/2004

OTHER PUBLICATIONS

Carton Lab; Finish Cradle; Apr. 2016; (https://web.archive.org/web/20160420132025/https://cartonlab.com/producto/cuna-de-carton-personalizada/).†
Holland; Dutch Design Chair; 2011; (https://shop.holland.com/en/dutch-design-chair-japanese-blossom-tim-vardy/).†
Dream on Me; 2 In 1 Portable Folding Stationary Side Crib; Jan. 2019; (https://www.amazon.com/Dream-Me-Portable-Folding-Stationary/dp/B0035ER8LW?th=1).†
Bloom; Alma Mini Crib; 2015; (https://usa.bloombaby.com/products/alma-mini).†

* cited by examiner
† cited by third party

*Primary Examiner* — David R Hare
*Assistant Examiner* — George Sun
(74) *Attorney, Agent, or Firm* — Polsinelli PC

(57) ABSTRACT

A collapsible bassinet that is selectively reconfigurable between a use configuration and a storage configuration, the bassinet including an outer structure, a support structure secured within the outer structure, a platform operable to be inserted within the outer structure and to rest on the support structure, and a sleeping pad operable to be inserted within the outer structure and to rest on the platform.

20 Claims, 11 Drawing Sheets

BASSINET

RELATED APPLICATIONS

The present application claims priority to U.S. Provisional Application No. 62/868,404, entitled "Bassinet"; filed on Jun. 28, 2019; the contents of which are incorporated herein by reference in their entirety.

FIELD

This disclosure relates to foldable cribs, bedside sleepers and bassinets.

BACKGROUND

Bassinets are products for children which are used for only a short period of time, usually up to 4 months for a newborn. It's difficult to find a product that provides a safe environment for a child to sleep in while still being easy to use for parents that can be fully recycled after the short duration of use. Most inexpensive bassinets are made of non-recyclable, synthetic materials including plastics and metals, which means a child sleeps in an unnatural environment. Cardboard bassinets, more commonly known as Baby Boxes, provide a more natural environment by using recyclable paper but the designs are often challenging to use because they are similar to storage boxes. These products typically sit directly on the floor which makes a child hard to reach for caretakers who are standing or in bed.

It is with these observations in mind, among others, that various aspects of the present disclosure were conceived and developed.

SUMMARY

The bassinet may include an outer structure, a support structure secured within the outer structure, and a platform. The outer structure and the support structure may include a plurality of walls and plurality of joints. The plurality of joints may be operable to allow the outer structure and the support structure to reconfigure between a use configuration and a storage configuration.

In the use configuration, the outer structure is intended to receive a child (e.g. an infant) and the platform is operable to be inserted within the outer structure and rest on the support structure to provide a safe elevated sleeping environment. The elevated sleeping environment is advantageous because it makes it easier for a caretaker to reach a child resting in the bassinet.

The bassinet may further include a sleeping pad that, when in the use configuration, may be inserted into the outer structure and rests on the platform. In various embodiments, the bassinet is intended to hold a child up to approximately 40 lbs. or until they show signs of rolling over or pushing up on hands and knees. The bassinet is inexpensive, easy to assemble and move, while providing a safe sleeping height for a child and offers the ability to be made of recyclable materials. The bassinet may be comprised of recyclable material such as cardboard, paperboard, or any other suitable foldable material making it inexpensive and light-weight. It has a compact footprint, is easy to move, for example a caretaker (e.g., a parent or guardian) can conveniently carry the light-weight bassinet without a child in it, from room to room.

The plurality of joints may comprise a plurality of folds in the outer structure and the support structure. The folds may be along a plurality of scores and/or perforations. The plurality of joints allows a caretaker to easily carry the bassinet from location to location as the joints in the design allow for easy foldability from the use configuration into the storage configuration.

The plurality of walls of the outer structure may include a first outer end wall, a second outer end wall parallel to the first outer end wall, a first outer side wall, and a second outer side wall parallel to the first outer side wall. The plurality of walls may form a hollow cuboid shape. However, it is foreseen that the plurality of walls may include any number of walls and may include any shape, such that the bassinet is operable to provide a safe elevated sleeping environment and is operable to be reconfigured between a use configuration and a storage configuration via the plurality of joints.

In the storage configuration, the first outer end wall, the second outer end wall, the first support end wall, and the second support end wall may be folded inward. Further, the first outer side wall and the first support side wall may be collapsed toward the second outer side wall and the second support side wall such that a width of the bassinet structure is compacted to approximately 10% of the width of the bassinet structure when in the use configuration.

The bassinet first outer end wall and the second outer end wall may include a top edge having a notch to allow easier folding from the use configuration to the storage configuration.

Another advantage of the present inventive concept is that it allows adequate airflow through the bassinet. The first outer side wall, the second outer side wall, the first support side wall, and the second support side wall may include air vents. The air vents may comprise cut-outs along the bottom edge of the side walls.

The plurality of walls defining the outer structure may each be folded along a top edge to form an interior portion and an exterior portion, to increase the strength of the outer structure.

Further, the top edge of each one of the first outer end wall and the second outer end wall may have rounded corners. The rounded corners may decrease potential injuries associated with sharp edges of the bassinet.

The outer structure may further include an outer flap extending from the first outer side wall and secured to the second outer end wall. Likewise, the support structure may include a support flap extending from the first support end wall and secured to the first support side wall. The flaps may be secured via an adhesive. However, it is foreseen that other means for securing the flaps may be used.

The platform may include a base with a plurality of holes or perforations to allow air flow through the platform. The platform may further include a first platform flap and a second platform flap. In the use configuration, the first platform flap and the second platform flap may be inserted between the outer structure and the support structure to secure the platform in place.

In some embodiments, the bassinet may be die-cut from a single sheet of material. The outer structure may be a single sheet of material having a first outer end and a second outer end. The first outer end may be secured to the second outer end. The support structure may be a single sheet of material having a first support end and a second support end. The first support end may be secured to the second support end.

A method for manufacturing the bassinet may comprise the step of cutting an outer structure from cardboard. The method may include the step of cutting a support structure from cardboard. The outer structure and the support structure may be a rectilinear shape. However, it is foreseen that the outer structure may comprise another shape.

The method may include applying a plurality of scores in the outer structure and the support structure. The plurality of scores may include scores and/or perforations. The method may further include folding the outer structure and the support structure along the plurality of scores.

The method may include securing a first outer end to a second outer end and securing a support structure first end to support structure second end.

The method may further include cutting a platform from cardboard. The platform may be operable to be inserted within the outer structure and rest on the support structure. The platform may be a rectilinear shape. However, it is foreseen that the outer structure may comprise another shape.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present inventive concept. It should be understood, however, that the present inventive concept is not limited to the precise embodiments and features shown. The accompanying drawings, which are incorporated in and constitute a part of this specification, illustrate various aspects of the present inventive concept and, together with the description, serve to explain advantages and principles consistent with the present inventive concept, in which.

DETAILED DESCRIPTION

Aspects of the present inventive concept relate to bassinets and methods for manufacturing bassinets.

Figure 1:
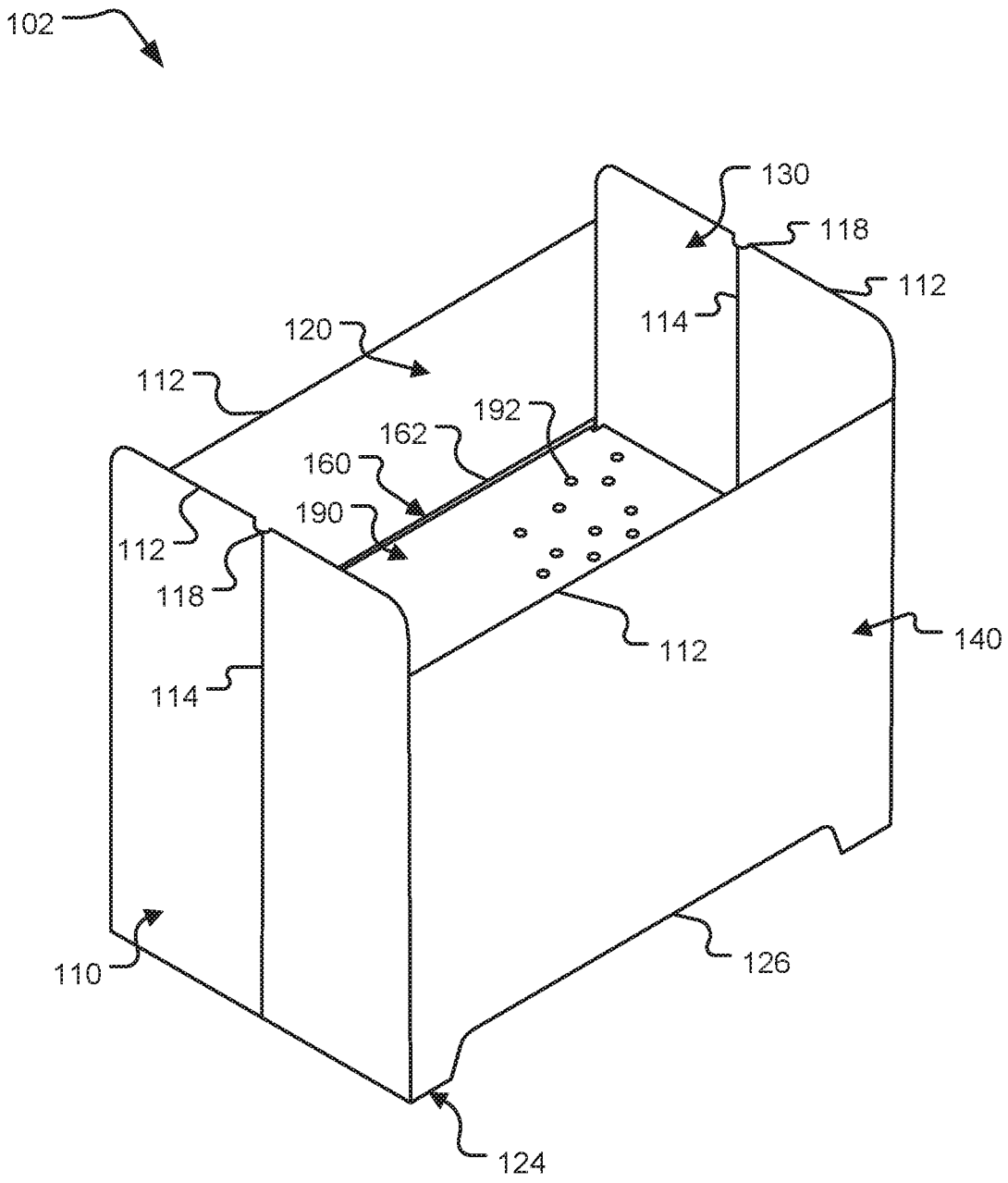
FIG. 1 shows an example embodiment of a bassinet.
Figure 2:
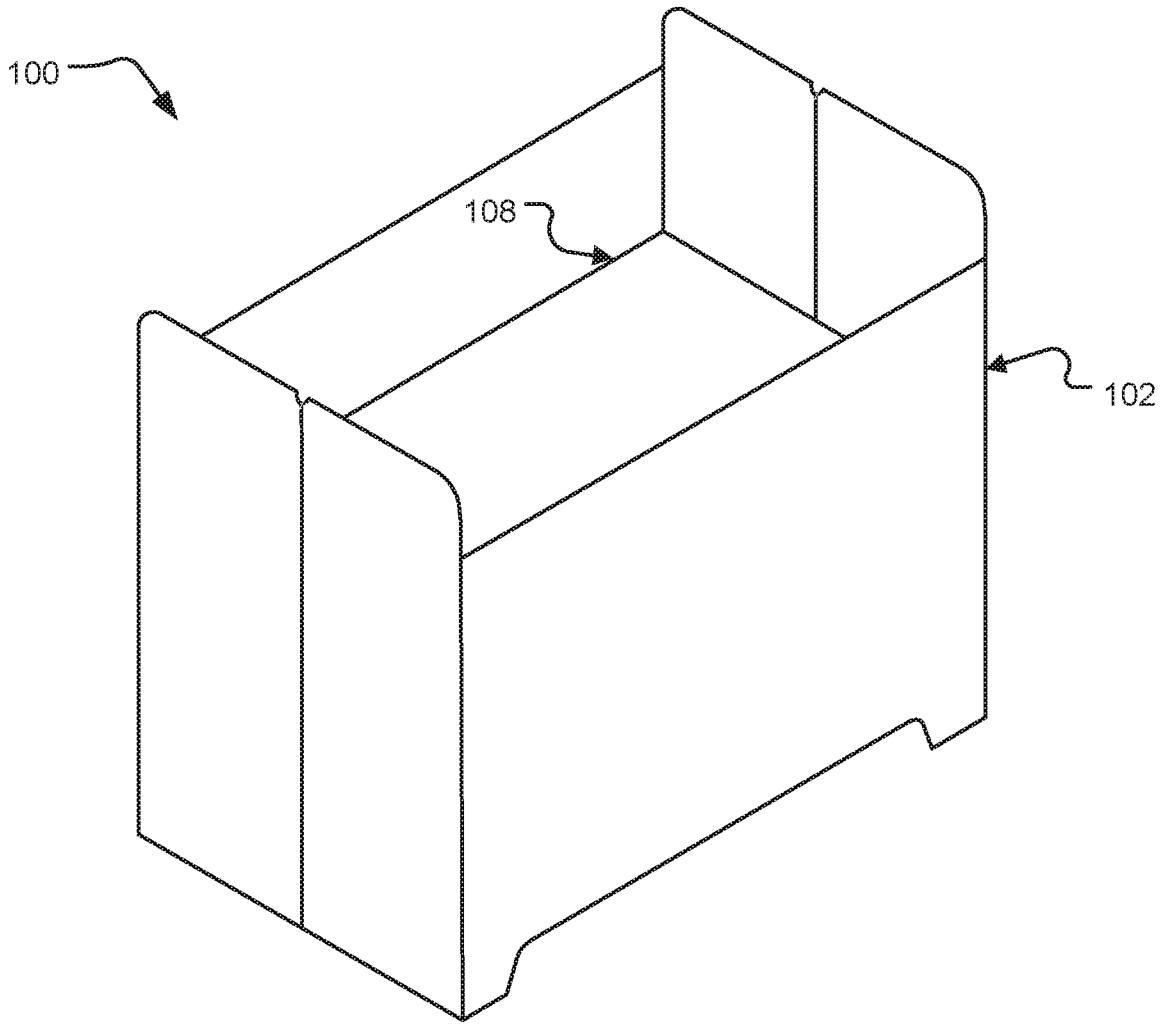
FIG. 2 is an example embodiment of the bassinet in the use configuration and showing additional features of the bassinet.
Figure 3:
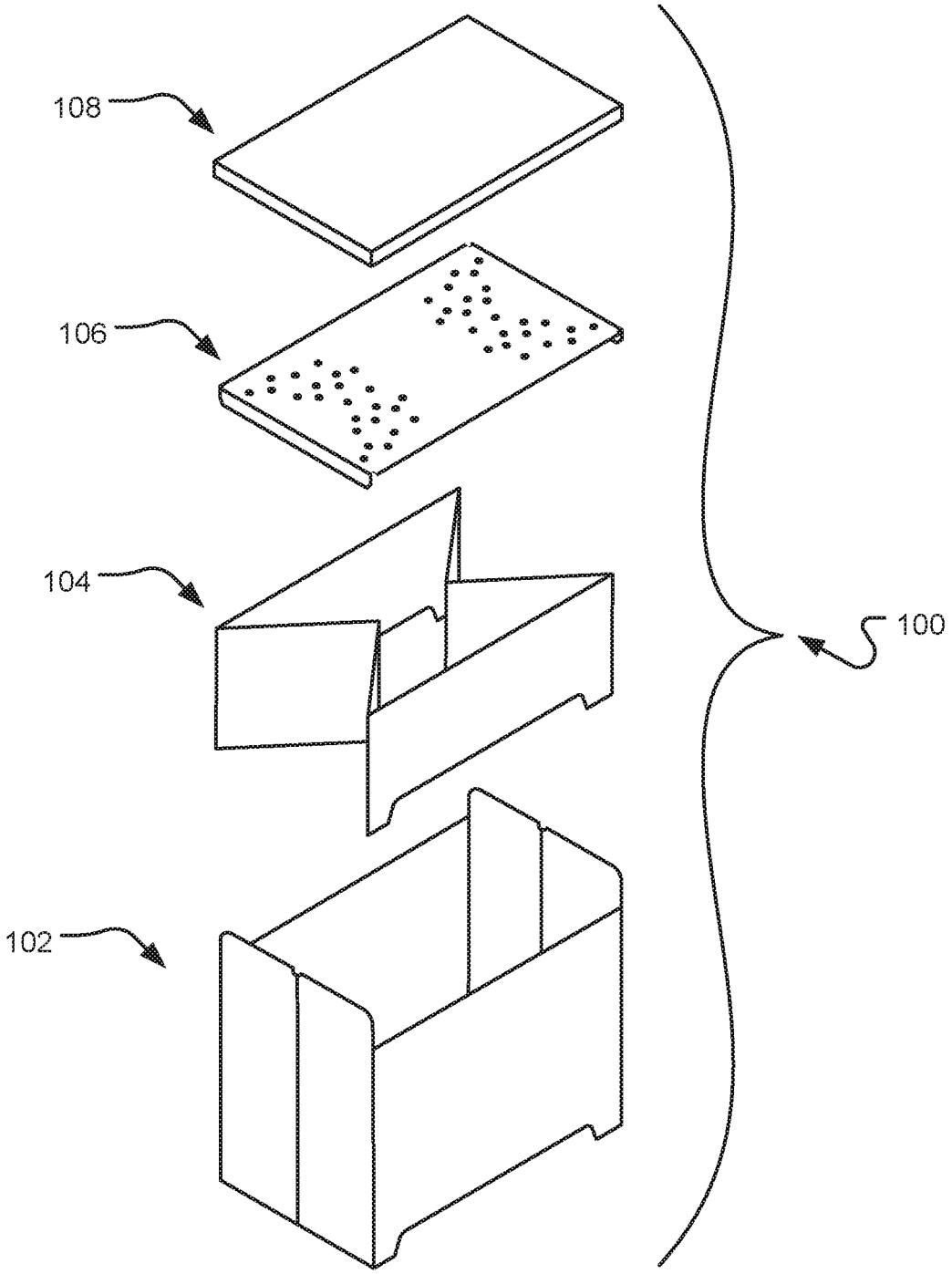
FIG. 3 is an exploded view of the bassinet of FIG. 2.

FIGS. 1-3 illustrate an example embodiment of a bassinet 100. As seen in FIG. 1, the bassinet 100 may include an outer structure 102, a support structure 104 secured within the outer structure 102, and a platform 106.

The support structure 104 may be secured within the outer structure 102 via an adhesive. However, it is foreseen that other means for securing the support structure 104 within the outer structure 102 may be used.

The bassinet 100 may be comprised of recyclable material such as cardboard, paperboard, or any other suitable foldable material making it inexpensive and light-weight. It has a compact footprint, is easy to move, for example a caretaker (e.g., a parent or guardian) can conveniently carry the light-weight bassinet 100 without a child in it, from room to room.

Figure 4B:
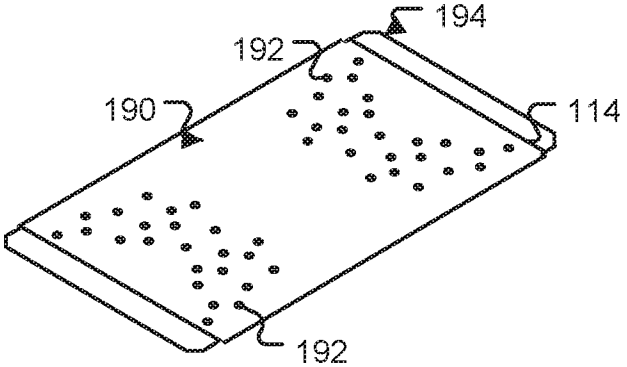
FIGS. 4A and 4B show the bassinet in the storage configuration.
Figure 4A:
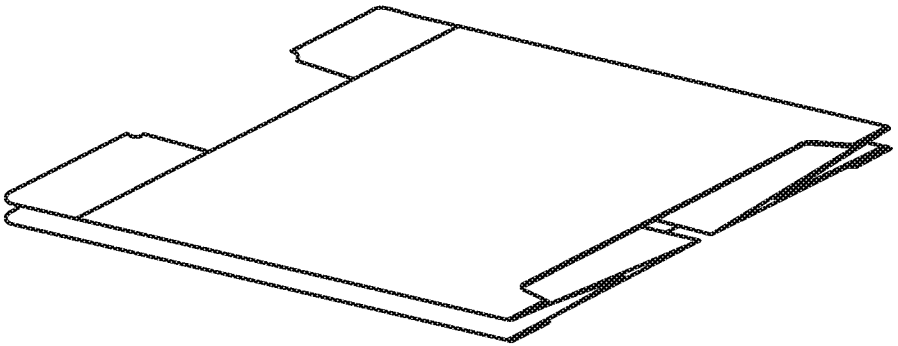

The outer structure 102 and the support structure 104 may include a plurality of walls, e.g., 110, 120, 130, 140, 150, 160, 170, and 180, and plurality of joints 114. The plurality of joints 114 may be operable to allow the outer structure 102 and the support structure 104 to reconfigure between a use configuration, as seen in FIGS. 1 and 2, and a storage configuration, as seen in FIGS. 4A and 4B.

The plurality of joints 114 may comprise a plurality of folds in the outer structure and the support structure. The folds may be along a plurality of scores and/or perforations. The plurality of joints 114 allow a caretaker to easily carry the bassinet 100 from location to location as the joints 114 in the design allow for easy foldability from the use configuration into the storage configuration.

When in the use configuration, the outer structure 102 is operable to receive a child (e.g., an infant) and the platform 106 is operable to be inserted within the outer structure 102 and rest on the support structure 104 to provide an elevated sleeping environment for the child. The elevated sleeping environment is also advantageous because it makes it easier for a caretaker to reach a child resting in the bassinet 100.

Turning to FIG. 2, the bassinet 100 may further include a sleeping pad 108 that may be inserted into the outer structure 102, when in the use configuration, and rests on the platform 106. The platform 106 defines a horizontal surface for the sleeping pad 108. The platforms shape and thickness is designed to stabilize the bassinet 100. Once the platform 106 is mounted, the plurality of walls cannot move or fold in any direction; the bassinet 100 is safely locked in place. The sleeping pad 108 can rest on top of the platform 106 so that the sleeping position is raised from the floor.

The bassinet 100 is intended to provide an inexpensive and temporary space at a height elevated above the ground, where a caregiver can easily access a child in a standing position or laying on a bed. The bassinet 100 is primarily intended but not limited to newborns up to 40 lbs. or until they show signs of rolling over or pushing up on hands and knees. The bassinet 100 can accommodate a range greater than what is intended while meeting all mechanical and mandatory certifications.

The bassinet 100 can be made of lightweight materials such as cardboard so that it can be convenient to move from room to room to encourage greater visibility of a child for a caregiver which in turn, helps reduce the chance of Sudden Infant Death Syndrome (SIDS).

The plurality of walls typically form a hollow cuboid shape, i.e., a cube with an open top and bottom, that can easily receive the platform 106 and sleeping pad 108 on the support structure 104. The platform 106 and sleeping pad 108 are inserted within the outer structure 102, lower than a top edge 112 of the outer structure 102, to create an interior cavity for a child to safely sleep in. However, it is foreseen that the plurality of walls may include any number of walls and may include any shape, such that the bassinet 100 is operable to provide a safe elevated sleeping environment and is operable to be reconfigured between the use configuration and the storage configuration via the plurality of joints 114. The support structure 104 may include a top edge 162.

FIG. 3 is an exploded view of the bassinet 100 of FIG. 2, showing the outer structure 102, the support structure 104, the platform 106, and the sleeping pad 108.

FIGS. 4A and 4B illustrate the storage configuration of an example embodiment of the bassinet 100. In the storage configuration, the first outer end wall, the second outer end wall, the first support end wall, and the second support end wall may be folded inward. Further, the first outer side wall and the first support side wall may be collapsed toward the second outer side wall and the second support side wall such that a width of the bassinet structure is compacted to approximately 5-10% of the width of the bassinet structure when in the use configuration. The bassinet 100, when in the storage configuration, has a compact footprint, is easy to move, and can be conveniently carried without a child in it, from room to room.

Figure 5:
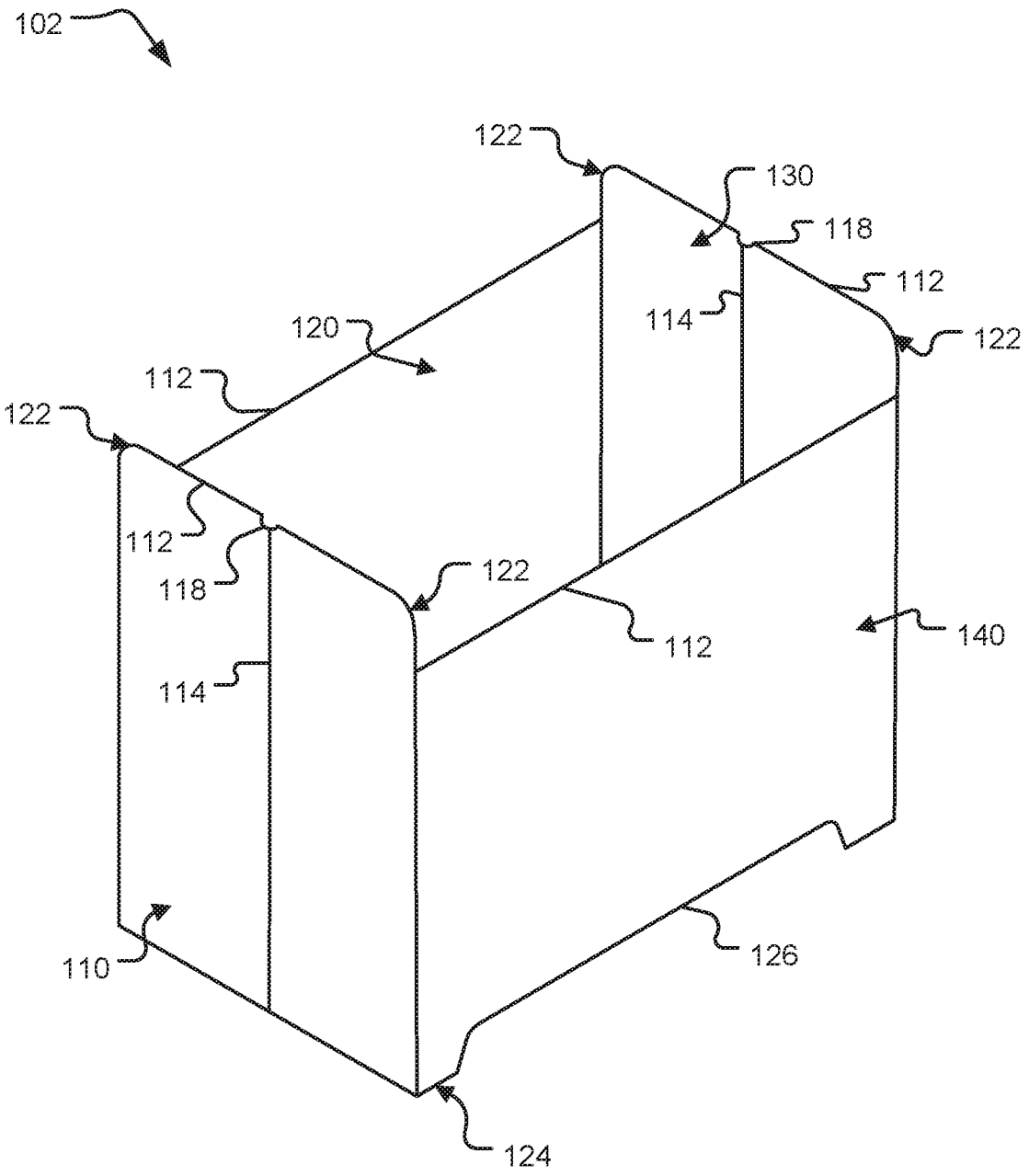
FIG. 5 shows the outer structure of the bassinet.

FIG. 5 shows the outer structure of the bassinet. The plurality of walls of the outer structure 102 may include a first outer end wall 110, a second outer end wall 130 parallel to the first outer end wall 110, a first outer side wall 120, and a second outer side wall 140 parallel to the first outer side wall 120.

Figure 8:
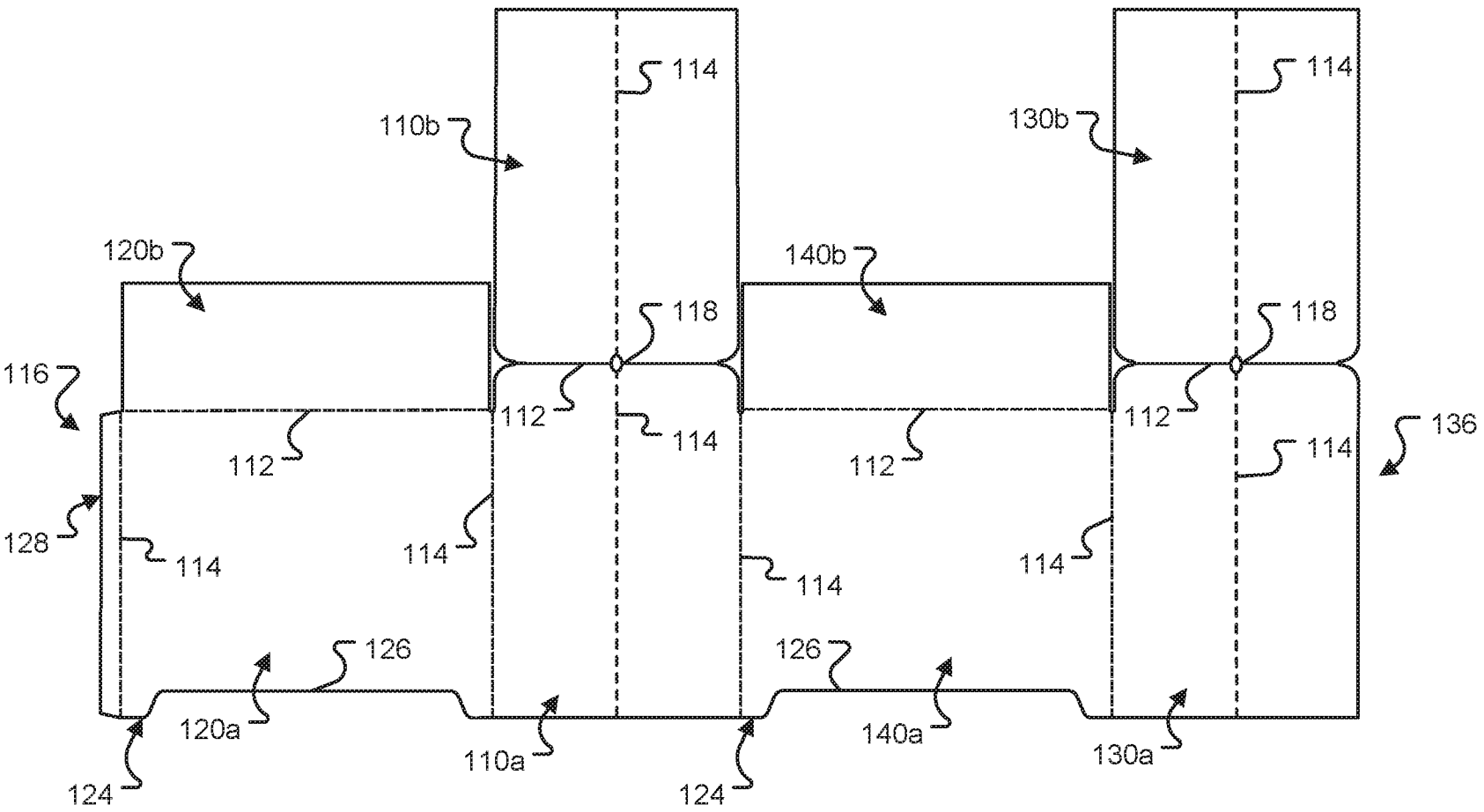
FIG. 8 shows a plan view of die cut material that may be folded to form the outer structure of the bassinet, according to one embodiment.

The top edge 112 of the outer structure 102 can reduce sharp edges by folding over each one of the plurality of walls of the outer structure, i.e., 110, 120, 130 and 140. This adds strength and cleanability to the edges where users may interact with the bassinet more frequently. For example, as seen in FIG. 8, the outer first end wall includes an interior portion 110*a* and an exterior portion 110*b*, the outer first side wall includes an interior portion 120*a* and an exterior portion 120*b*, the outer second end wall includes an interior portion 130*a* and exterior portion 130*b*, the outer second side wall includes an interior portion 140*a* and exterior portion 140*b*.

Sharp corners can be reduced by increasing the height of the outer end walls 110, 130 over the outer side walls 120, 140, as seen in FIG. 5. Additionally, each corner 122 along the top edge 112 may be curved or rounded to reduce the chance of injury that is common with regular boxes.

The top edge 112 of the first outer end wall 110 and the second outer end wall 130 may each include a notch 118 to allow for easier folding of the bassinet 100 from the use configuration to the storage configuration. The notch 118 may be a half circle. However, it is foreseen that the notch 118 can take different shapes. The notch 118 allows the outer end walls 110 and 130 to fold into a more compact shape by reducing the material where the outer end walls 110 and 130 would collide if it weren't for the notch 118 when collapsed. Additionally, the notch 118 may also provide a functional attachment point for accessories that can be added to the bassinet. The notch location, at the top of a folded edge allows for a registration point that can provide a defined orientation for an accessory, for example an upright camera. Additional holes may also be provided next to the notch to further provide stability for attachments. Accessories that could attach to the system may include, but not limited to, a video monitor using a mounted camera, a light fixture to illuminate a child at night and a rotating mobile to help a child sleep.

Figure 6:
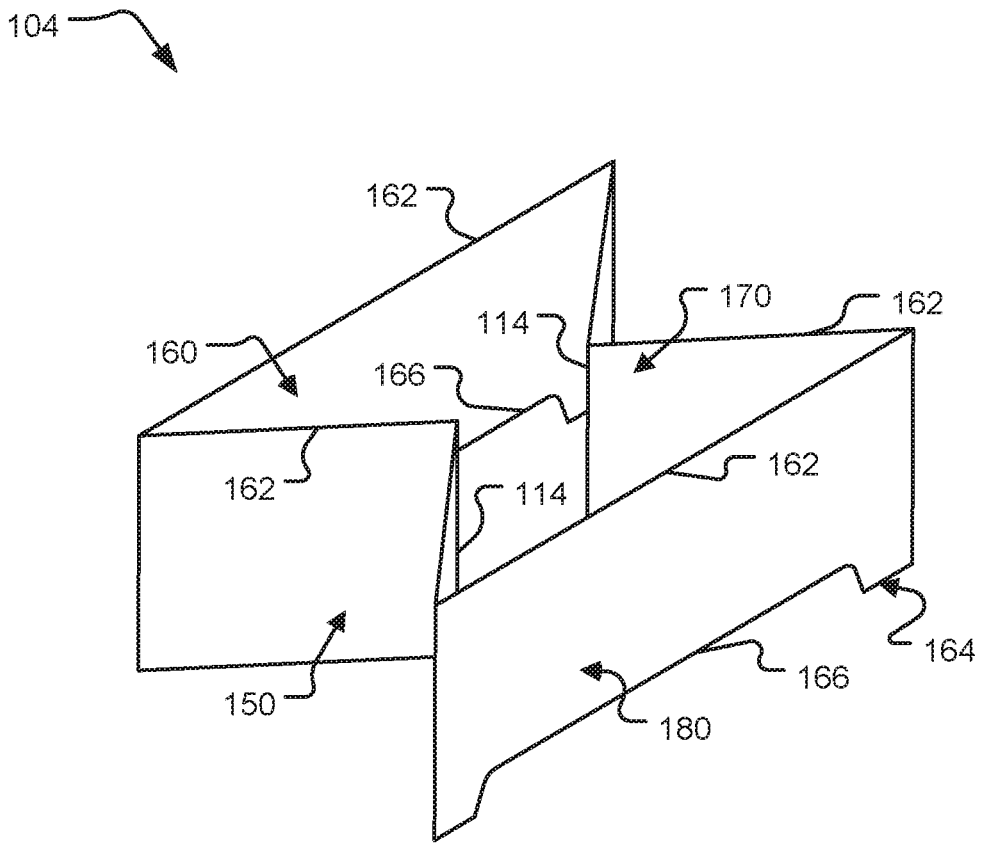
FIG. 6 shows the support

As seen in FIG. 6, the plurality of walls of the support structure 104 may include a first support end wall 150, a second support end wall parallel to the first support end wall 170, a first support side wall 160, and a second support side wall 180 parallel to the first support side wall 160.

The plurality of walls may include air vents to allow adequate air flow through the bassinet. For example, as depicted in FIG. 5, the first outer side wall 120 and the second outer side wall 140 include outer cut-outs 126 along a bottom edge 124 of the outer side walls 120, 140. Likewise, as depicted in FIG. 6, the first support side wall 160 and the second support side wall 180 include support cut-outs 166 along a bottom edge 164 of the support side walls 160, 180.

Figure 7:
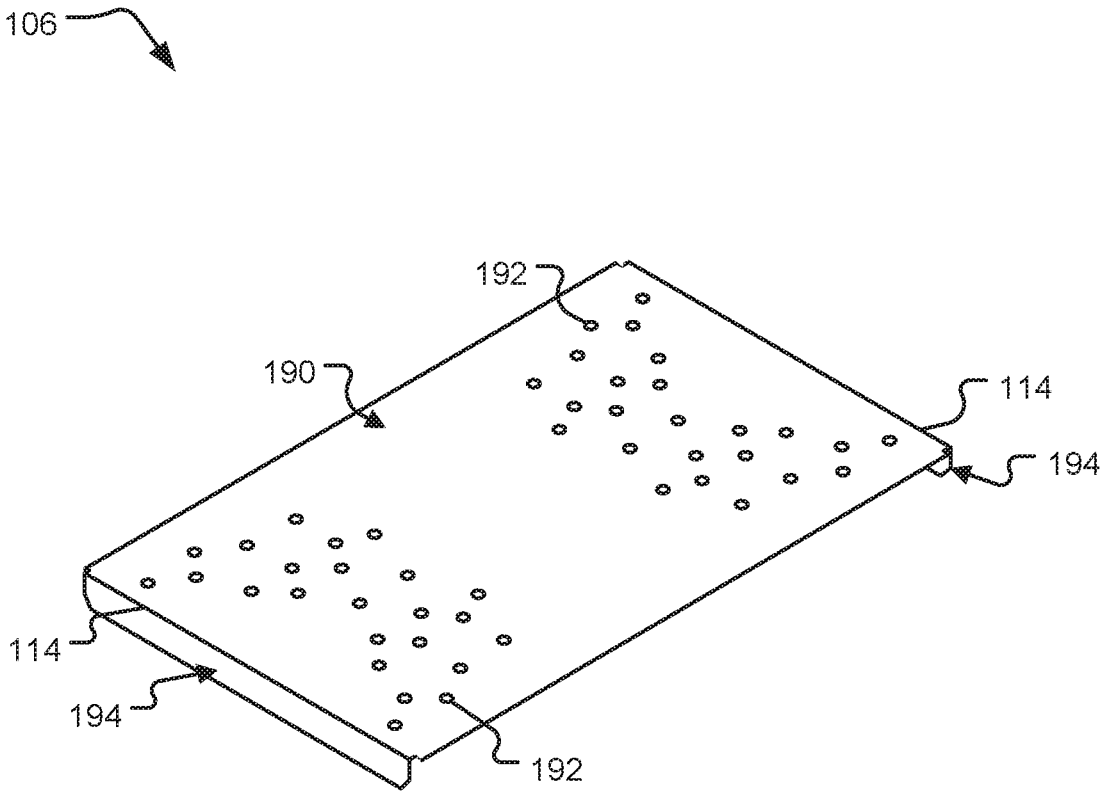
FIG. 7 shows the platform of the bassinet.

FIG. 7 shows the platform 106 of an example embodiment of the bassinet 100. The platform may include a base 190 with a plurality of holes or perforations 192 to allow air flow through the platform 106. The platform 106 may include the plurality of joints 114. The plurality of joints 114 may comprise a plurality of folds. The plurality of platform flaps 194 may be reconfigurable between the use and storage configurations via the plurality of joints 114.

Thus, the bassinet 100 can allow for airflow between the internal cavity to the bottom of the bassinet which can reduce the chance of carbon dioxide poisoning, a cause attributed to SIDS. This is achieved with a combination of breathable sleeping pad 108 materials, the perforations 192 in platform 106, and the cut-outs 126 and 166 along the bottom edges 124 and 164 of the outer structure and support structure, respectively. As carbon dioxide is heavier than air it has the opportunity to flow downwards through the bassinet 100 and on to the floor.

When in the use configuration, the plurality of platform flaps 194 may be folded perpendicular to the base 190. The platform may be inserted within the outer structure 102, rest on the support structure 104, and the plurality of platform flaps may be inserted between the outer structure 102 and the support structure 104. The platform may provide a horizontal surface for the sleeping pad 108.

The outer structure may further include an outer flap extending from the first outer side wall and secured to the second outer end wall. Likewise, the support structure may include a support flap extending from the first support end wall and secured to the first support side wall. The flaps may be secured via an adhesive. However, it is foreseen that other means for securing the flaps may be used.

The system can be easily assembled without using any tools in three simple steps: a user may (1) expand the outer structure 102 and support structure 104 from the storage configuration to the use configuration, (2) place the platform 106 with platform flaps 194 facing down into the outer structure 102, and (3) place the sleeping pad 108 on top of the platform 106.

The system can be conveniently moved from room to room within a home or between locations such as from one caregiver's home to another. This is possible as disassembly requires no tools and the bassinet 100 be compacted to 10% of the assembled width. In order to achieve this thickness, plurality of joints 114 or folds on the outer end walls 110, 130, and support end walls 150, 170, of the bassinet 100 are designed to fold inwards. The outer structure 102 and the support structure 104 nest together so that the bassinet 100 can become only 10% of its assembled width.

Figure 9:
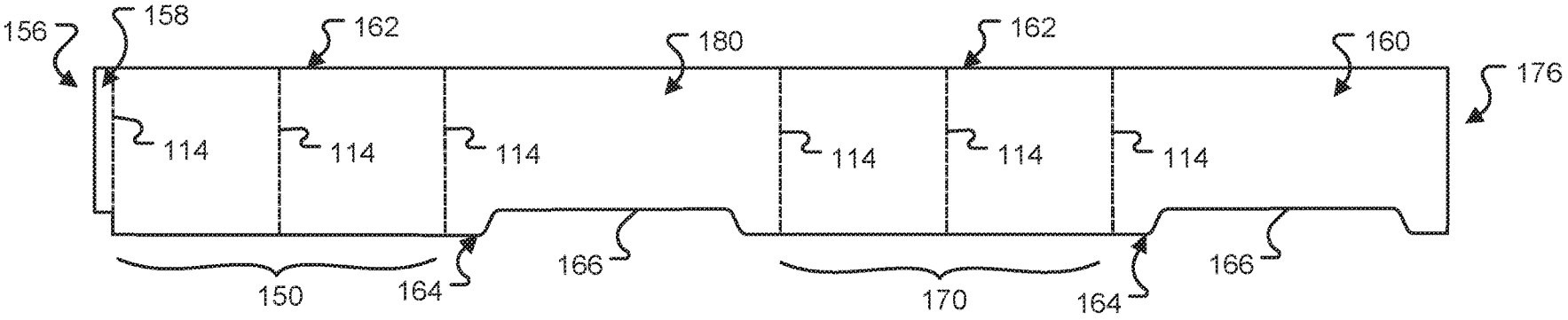
FIG. 9 shows a plan view of die cut material that may be folded to form the support structure of the bassinet, according to one embodiment.
Figure 10:
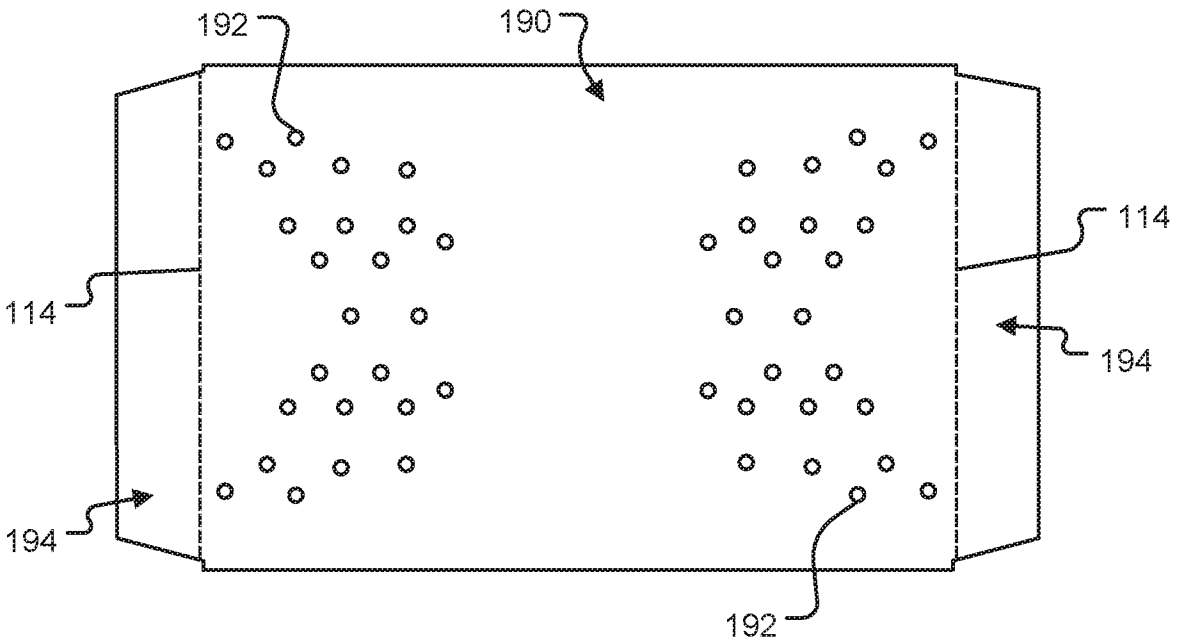
FIG. 10 illustrates a plan view of die cut material that may be folded to form the platform of the bassinet, according to one embodiment.

In some embodiments, the outer structure 102, the support structure 104, and the platform 106 may be die-cut from a single sheet of material, as seen in FIGS. 8-10. The outer structure 102, the support structure 104, and the platform 106 may be environmentally friendly, as each may be produced using a die cut from a single sheet of flat material which can be recyclable and/or compostable such as cardboard. The die cut can also include scores and perforations that allow the components to be folded to a compact shipping size.

FIG. 8 shows a plan view of die cut material that may be folded to form the outer structure 102 of the bassinet 100, according to one embodiment. The outer structure 102 may be a single sheet of material having a first outer end 116 and a second outer end 136. The first outer end 116 may be secured to the second outer end 136. For example, an outer flap 128 may extend from the first outer side wall 120. The first outer end 116 may be secured to the second outer end 136 via the outer flap 128. The outer flap 128 may be secured to the second outer end 136 via an adhesive. However, it is foreseen that other means of attachment may be used. Further, the outer flap 128 may be secured between the interior portion 130*a* and exterior portion 130*b* of the outer second end wall 130.

FIG. 9 shows a plan view of die cut material that may be folded to form the support structure 104 of the bassinet 100, according to one embodiment. The support structure 104 may be a single sheet of material having a first support end 156 and a second support end 176. The first support end 156 may be secured to the second support end 176. For example, a support flap 158 may extend from the first support end wall 150. The first support end 156 may be secured to the second support end 176 via the support flap 158. The support flap 158 may be secured to the second support end 176 via an adhesive. However, it is foreseen that other means of attachment may be used.

FIG. 10 illustrates a plan view of die cut material that may be folded to form the platform 106 of the bassinet 100, according to one embodiment.

Figure 11:
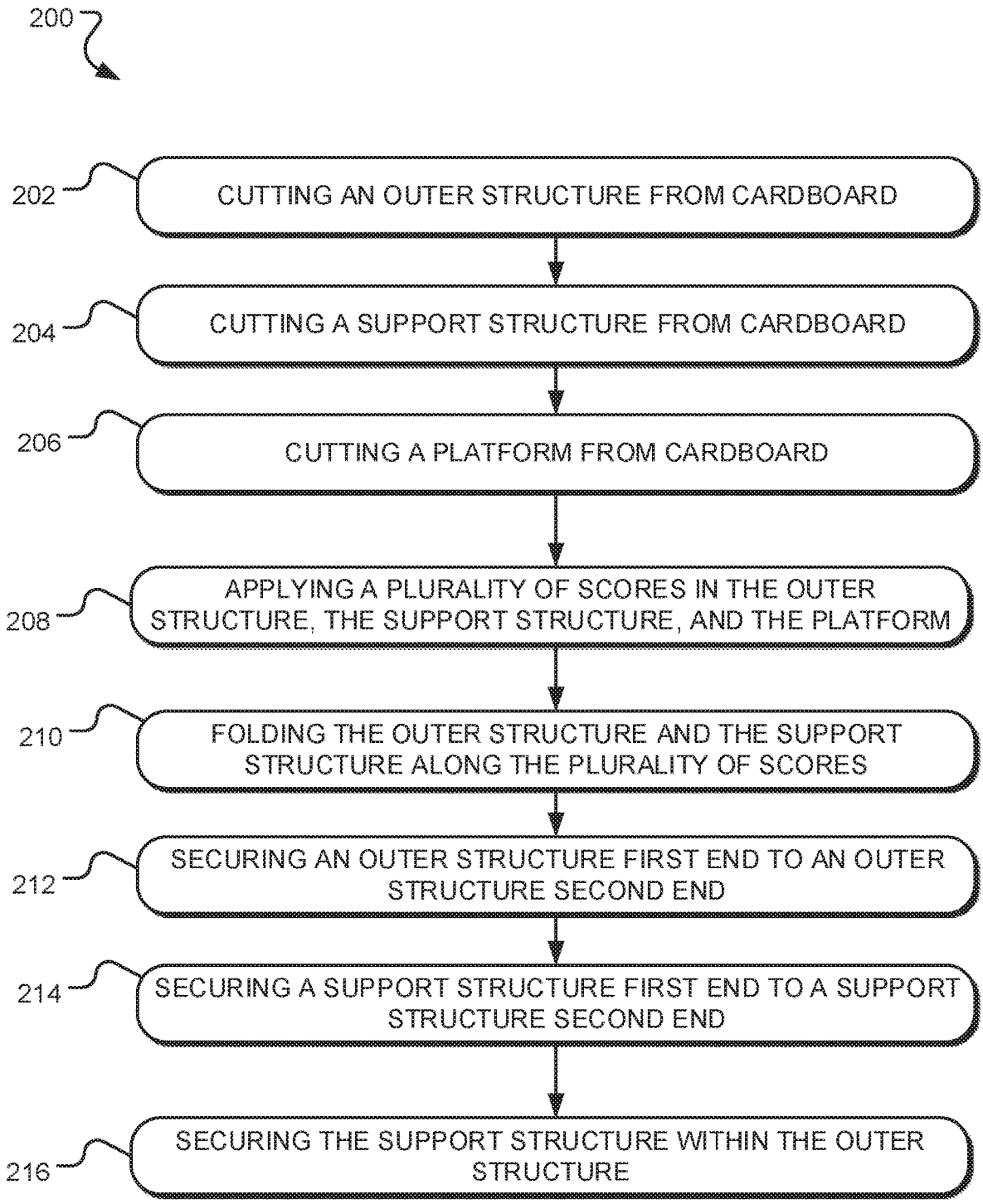
FIG. 11 is a flow chart illustrating an example method for manufacturing a bassinet, according to one embodiment.

FIG. 11 is a flow chart illustrating an example method for manufacturing a bassinet, according to one embodiment.

The bassinet is built using four parts, including the outer structure 102, the support structure 104 and the platform 106. The bassinet may also include the sleeping pad 108. All parts, except the sleeping pad, are made of a single piece of die cut sheet material and may use different folding and adhesion techniques. Thus, the method 200 may include step 202 cutting an outer structure from cardboard, step 204 cutting a support structure from cardboard, and step 206, cutting a platform from cardboard. The outer structure and the support structure may comprise rectilinear shapes.

The method 200 may include step 208, applying a plurality of scores in the outer structure, the support structure, and the platform. The plurality of scores may comprise scores and/or perforations.

The outer structure and support structure may be assembled during manufacturing by folding the outer structure and the support structure along the plurality of scores and/or perforations, via step 210. The method 200 may include step 212, securing an outer structure first end to an outer structure second end. The method 200 may further include step 214, securing a support structure first end to a support structure second end. The support structure may be secured within the outer structure via step 216.

The method 200 may include cutting a plurality of air vents along a bottom edge of the outer structure and a bottom edge of the support structure. The method 200 may further include cutting a plurality of holes in the platform.

The customer may insert the platform and the sleeping pad into to the bassinet structure as part of the 3-step installation.

In various aspects, the system can range in functions and size. In one aspect, the system may be a bassinet for a child to sleep in. In another aspect, the system may have one lower side wall to form a stool or chair. In another aspect, the system can include additional parts such as a shipping package designed to form the roof for a portable play space such as a small play house. In another aspect, the bassinet 100 structure can be used to provide the structure for temporary emergency beds that are light weight, flat packed, and easy to assemble.

In various aspects, the system can be constructed using any suitable material without limitation. In one aspect, the bassinet structure and platform may be constructed from sustainably sourced materials like cardboard to provide a curb-side recyclable or compostable product. In another aspect, the bassinet structure may be made of polyethylene corrugated plastic and the platform made of wood to provide a durable and rigid product.

The foregoing merely illustrates the principles of the present inventive concept. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the present inventive concept and are thus within the spirit and scope of the present inventive concept. From the above description and drawings, it will be understood by those of ordinary skill in the art that the particular embodiments shown and described are for purposes of illustrations only and are not intended to limit the scope of the present inventive concept. References to details of particular embodiments are not intended to limit the scope of the present inventive concept.

The invention claimed is:

1. A bassinet, comprising:

an outer structure defining an outer structure perimeter wall having a plurality of outer structure joints;

a support structure configured for placement within the outer structure, the support structure defining a support structure perimeter wall having a plurality of support structure joints;

a platform;

a sleeping pad; and wherein, the plurality of outer structure joints and the plurality of support structure joints are operable to allow the outer structure and the support structure to reconfigure between a use configuration and a storage configuration, and when the bassinet is in the use configuration, the support structure perimeter wall is disposed within and contacts the outer structure perimeter wall, the platform is inserted within the outer structure to rest on the support structure, and the sleeping pad is inserted within the outer structure to rest on the platform.

2. The bassinet of claim 1, wherein:

the outer structure, the support structure, and the platform comprise cardboard.

3. The bassinet of claim 2, wherein:

each one of the outer structure and the support structure comprise a single sheet of cardboard; and the plurality of outer structure joints and the plurality of support structure joints comprise a plurality of folds in each of the respective sheets of cardboard.

4. The bassinet of claim 1, wherein:

the outer structure perimeter wall includes a first outer end wall, a second outer end wall parallel to the first outer end wall, a first outer side wall, and a second outer side wall parallel to the first outer side wall; and the support structure perimeter wall includes a first support end wall, a second support end wall parallel to the first support end wall, a first support side wall, and a second support side wall parallel to the first support side wall.

5. The bassinet of claim 4, wherein the bassinet is configured to collapse to the storage configuration and when in the storage configuration, the first outer end wall and the second outer end wall are folded inward, the first support end wall and the second support end wall are folded inward, the first outer side wall is collapsed toward the second outer side wall, the first support side wall is collapsed toward the second support side wall, and a storage width of the bassinet is compacted to approximately 10% of the width of the bassinet when in the use configuration.

6. The bassinet of claim 4, wherein:

each one of the first outer end wall and the second outer end wall include a top edge having a notch to allow easier folding from the use configuration to the storage configuration.

7. The bassinet of claim 4, wherein:

each one of the first outer side wall, the second outer side wall, the first support side wall, and the second support side wall include a bottom edge having an air vent to allow air flow through the bassinet.

8. The bassinet of claim 4, wherein:

the outer structure perimeter wall is folded along an outer structure top edge of the outer structure perimeter wall to define an interior portion and an exterior portion of the outer structure perimeter wall.

9. The bassinet of claim 4, wherein:

each one of the first outer end wall and the second outer end wall have a top edge with rounded corners.

10. The bassinet of claim 4, wherein:

the outer structure includes an outer flap (i) extending from the first outer side wall, and (ii) an outer flap interior surface or an outer flap exterior surface of the outer flap is secured to the second outer end wall such that the outer flap and the second outer end wall overlap; and the support structure includes a support flap (i) extending from the first support end wall, and (ii) a support flap interior surface or a support flap exterior surface is secured to the first support side wall such that the support flap and the first support side wall overlap.

11. The bassinet of claim 10, wherein:

the outer flap and the support flap are secured via an adhesive.

12. The bassinet of claim 1, wherein:

the platform includes a base having a plurality of perforations to allow air flow through the platform.

13. The bassinet of claim 1, wherein:

the platform further includes a first platform flap and a second platform flap; and when in the use configuration, the first platform flap and the second platform flap extend downward from the base and are inserted between the outer structure and the support structure.

14. The bassinet of claim 4, wherein when in the use configuration:

the first support end wall contacts the first outer end wall; and the second support end wall contacts the second outer end wall.

15. A bassinet, comprising:

an outer structure including an outer structure perimeter wall;

a support structure including a support structure perimeter wall, the support structure secured within and contacting the outer structure; and a platform, the platform operable to be inserted within the outer structure and resting on the support structure;

wherein, the outer structure perimeter wall is a first single sheet of material having an outer first end and an outer second end, the outer first end secured to the outer second end, the support structure perimeter wall is a second single sheet of material having a support first end and a support second end, the support first end secured to the support second end, each of the first single sheet of material and the second single sheet of material have a plurality of folds, and the plurality of folds permitting the outer structure and the support structure to be reconfigured between a use configuration and a flat storage configuration.

16. A method for manufacturing a bassinet, the method comprising the steps of:

cutting an outer structure from cardboard;

cutting a support structure from cardboard;

cutting a platform from cardboard;

applying a plurality of scores in the outer structure, the support structure, and the platform;

folding the outer structure and the support structure along the plurality of scores;

securing an outer structure first end to an outer structure second end to form an outer structure perimeter wall;

securing a support structure first end to a support structure second end to form a support structure perimeter wall; and securing the support structure within the outer structure;

wherein the platform is operable to (i) be inserted within the outer structure, and (ii) rest on the support structure.

17. The method of claim 16, wherein:

the outer structure comprises a first single sheet of cardboard; and the support structure comprises a second single sheet of cardboard.

18. The method of claim 16, wherein:

the plurality of scores in the outer structure define a first outer end wall, a first outer side wall, a second outer end wall, and a second outer side wall; and the plurality of scores in the support structure define a first support end wall, a first support side wall, a second support end wall, and a second support side wall.

19. The method of claim 18, wherein:

the plurality of scores in the outer structure further define an outer flap;

the plurality of scores in the support structure further define a support flap;

securing the outer structure first end to the outer structure second end comprises securing the outer flap to the second outer end wall; and securing the support structure first end to the support structure second end comprises securing the support flap to the first support side wall.

20. The method of claim 18, further comprising:

cutting a plurality of air vents along an outer bottom edge of the outer structure and a support bottom edge of the support structure; and cutting a plurality of holes in the platform.

* * * * *